United States Patent [19]

Yasuda et al.

[11] Patent Number: 4,589,931

[45] Date of Patent: May 20, 1986

[54] METHOD OF PRODUCING A THIN STEEL SHEET HAVING BAKING HARDENABILITY AND ADAPTED FOR DRAWING

[75] Inventors: Akira Yasuda; Toshio Irie; Motoyuki Konishi, all of Chiba, Japan

[73] Assignee: Kawasaki Steel Corporation, Kobe, Japan

[21] Appl. No.: 709,982

[22] PCT Filed: Nov. 21, 1981

[86] PCT No.: PCT/JP81/00353

§ 371 Date: Jul. 23, 1982

§ 102(e) Date: Jul. 23, 1982

[87] PCT Pub. No.: WO82/01893

PCT Pub. Date: Jun. 10, 1982

Related U.S. Application Data

[63] Continuation-in-part of Ser. No. 545,105, Oct. 24, 1983, abandoned, which is a continuation of Ser. No. 403,617, Jul. 23, 1982, abandoned.

[30] Foreign Application Priority Data

Nov. 26, 1980 [JP] Japan ..... 55-165315

[51] Int. Cl.[4] ..... C21D 9/48

[52] U.S. Cl. ..... 148/12 C; 148/12 D

[58] Field of Search ..... 148/12 C, 12 D, 12 F, 148/12.4

[56] References Cited

U.S. PATENT DOCUMENTS 4,315,783 2/1982 Akisve et al. ..... 148/12 C

FOREIGN PATENT DOCUMENTS 25891 8/1975 Japan ..... 148/12 F 104417 8/1979 Japan ..... 148/12 C

*Primary Examiner*—Wayland Stallard

*Attorney, Agent, or Firm*—Balogh, Osann, Kramer, Dvorak, Genova & Traub

[57] ABSTRACT

The present invention provides a method for producing a thin cold rolled steel sheet, which is adapted to be formed into, for example, an external automotive plate. The method includes an appearance-finishing step by bake-coating as a final step after drawing (such as press molding), and has a remarkably high baking hardenability. The baking hardenability is a property for improving the yield strength due to the heating during the bake coating treatment and is particularly advantageous for producing a light weight automobile and for compensating the deterioration of dent resistance of the automotive plate due to the lowering of its weight, (without deteriorating the $\bar{r}$ value). The latter is an indication of the press moldability of the thin steel sheet. Furthermore, the present invention discloses an effective compounding amount of Ti which acts to fix C, S and N contained in the steel, and a continuous annealing condition properly selected depending upon the effective amount of Ti.

1 Claim, 4 Drawing Figures

METHOD OF PRODUCING A THIN STEEL SHEET HAVING BAKING HARDENABILITY AND ADAPTED FOR DRAWING

This is a continuation-in-part of co-pending application Ser. No. 545,105 filed on Oct. 24, 1983 now abandoned, which is a continuation of Ser. No. 403,617 filed July 23, 1982, now abadoned.

TECHNICAL FIELD

Cold rolled steel sheets or zinc-plated steel sheets produced from the cold rolled steel sheet are used as an exterior automotive plate in a large amount. These steel sheets are subjected to a drawing treatment, such as a press molding, and then to a bake coating at the use, and these steel sheets for drawing can satisfy advantageously the demand for dent resistance by improving the yield strength due to the heating during the bake coating, that is, by improving so-called baking hardenability. The baking hardenability is evaluated by the BH value of the total increased value of yield strength of a steel sheet in the case where the steel sheet is prestrained under a tension of 2% and then subjected to a heat treatment of 170° C. for 20 minutes. The baking hardenability of a steel sheet must be improved without deteriorating the drawability represented by the Lankford value $\bar{r}$.

The present invention belongs to a technical field relating to a method of producing a thin steel sheet adapted for drawing and having high $\bar{r}$ value and BH value and excellent striking energy-absorbing property, from a cold rolled steel sheet, particularly from a high tensile strength cold rolled steel sheet; or from a metal- or alloy-plated steel sheet produced from these cold rolled steel sheets and having a plated film at least on one surface, the metal- or alloy-plated steel sheet being hot dip plated steel sheet, particularly zinc hot dip plated steel sheet, whose plated zinc film may be formed into alloy, aluminum plated steel sheet, lead-tin plated (terne plated) steel sheet and the like.

BACKGROUND ART

Rimmed steel has been used for a long period of time due to its excellent surface property for obtaining beautiful finishing of coating. The rimmed steel has an ageing property at room temperature due to the presence of nitrogen solid solved therein, and when the rimmed steel is press molded just after the cold rolling, the yield strength is increased due to the strain ageing by nitrogen without generation of stretcher-strain at the bake coating.

Recently, continuous casting technic of steel has been progressed and developed, and a large amount of aluminum killed steel having a moldability superior to that of conventional rimmed steel is used without substantially increasing the production cost of automobile in place of the conventional rimmed steel as a thin steel sheet for drawing, which is mainly used for exterior automotive plate.

Aluminum killed thin steel sheet is excellent in the deep drawing property, but is generally poor in the baking hardenability due to the presence of nitrogen fixed by aluminum.

While, when it is intended to use high tensile strength steel sheet in order to produce automobiles having a light weight, it is necessary to give baking hardenability, particularly an improved baking hardenability, to the high tensile strength steel sheet in order to compensate the decreasing of the dent resistance due to the decreasing of the sheet thickness from the view point of safety.

Ferrite-martensite dual phase steel sheet has a satisfactorily high baking hardenability, but has generally a low $\bar{r}$ value of about 1.0, and is poor in the drawability. Therefore, the use field of ferrite-martensite dual phase steel sheet is limited.

While, in order to produce a thin steel sheet having a high $\bar{r}$ value, there have been proposed the following treatments. That is, aluminum killed cold rolled steel sheet, which has been strengthened by adding phosphorus thereto, is subjected to an open coil annealing and solid solved carbon is left in the steel to develop the strain ageing property by utilizing such a property that the open coil annealed steel can be cooled at a rapid cooling rate. Alternatively, the aluminum killed cold rolled steel sheet is subjected to a tight coil annealing at a particularly high temperature to form coarse carbide and to disturb the precipitation of solid solved carbon, whereby solid solved carbon is left in the steel (For example, refer to Iron and Steel, Vol. 66, page A209 (1980)). However, in the former method, additional treating steps, wherein the steel sheet is rewound into an open coil and into a tight coil before and after annealing respectively, must be carried out. While, in the latter method, fusing of the adjacent layers of the coiled steel sheet occurs and further the inner cover (retort) of the annealing furnace is thermally deformed. Therefore, the production cost is very high. Moreover, it has been found that the phosphorus-containing low carbon aluminum killed steel sheet, that is, so-called rephos steel, which has been subjected to the above described treatments, is not always satisfactory in the $\bar{r}$ value and yield strength.

While, a steel sheet having a high $\bar{r}$ value and a low yield point, which is produced by adding Ti, Nb and the like to extra low carbon steel to fix C and N, and by adding P, Mn and the like thereto to form a solid solution and to strengthen the steel, is used in the automotive parts more widely than the above described rephos steel. However, the steel has a low yield strength and a high tensile strength, and therefore when plastic strain is applied to the steel, the steel has a remarkably high hardenability in the working. However, it is impossible to cause uniform plastic deformation over an entire working range of the molding by a press mold depending upon the shape of parts produced by the molding. Accordingly, the portion, to which a low plastic strain is applied, still has a low yield strength, and is easily deformed by a small external force.

In order to obviate the above described drawbacks, there have been attempts to give the baking hardenability to such steel. That is, Japanese Patent Laid-Open Application No. 114,717/78 discloses Ti addition, Japanese Patent Application Publication No. 30,528/76 discloses Zr addition and Japanese Patent Laid-Open Application No. 130,819/74 discloses Nb addition. In all these methods, Ti, Zr and the like are contained in a steel in an amount a little smaller than the amount of C+N in order that C and N in the steel are not completely fixed but solid solved C and N are left in the steel in an amount not to cause deterioration of deep drawing property while directing to the prevention of ageing at room temperature, and further the steel is cooled at a cooling rate, which does not cause carbide and nitride of iron precipitated in the relatively low temperature region in the cooling step after the annealing.

However, even in these methods, a little amount of solid solved C and N is always contained in the steel sheet before the cold rolling and at the recovery-recrystallization step after annealing. Therefore, the steel has a serious drawback that the development of aggregation structure suitable for $\bar{r}$ value is hindered. Therefore, it has been difficult to give a baking hardenability to the steel while maintaining a high $\bar{r}$ value.

For example, as to Nb addition, according to the above described Japanese Patent Laid-Open Application No. 130,819/74, an Nb-containing steel, which contains, in % by weight, 0.004% of C, 0.03% of Al and 0.062% of Nb, is hot rolled, and then continuously annealed at a uniform temperature of 800° C., whereby a steel sheet having an age hardening value of 17.8 $kg/mm^2$ is obtained (by treatment of prestraining under 3% tension and then artificial ageing treatment at 200° C. for 30 minutes). However, the $\bar{r}$ value is only about 1.71, and further the amount of Nb is excessively large as compared with the amount of C, and the steel sheet is low in the elongation and is not satisfactory in the ductility. Moreover, a steel sheel containing Nb, Ti or Zr becomes very brittle by the press molding, and, therefore, the steel sheet is very difficult to be secondarily worked. Further, the steel sheet, after being assembled into an automobile or the like, is poor in the striking energy-absorbing property. Therefore, the use of the steel sheet has a problem in the safety.

DISCLOSURE OF THE INVENTION

The inventors have found that, when a proper amount of Ti is added to a low carbon steel, which contains Mn and Si and further contains P, S and N as an incidental impurity, depending upon the contents of [C], [S] and [N] in the steel, the harmful action of S and N, which stiffens a cold rolled steel sheet of the above described low carbon steel, can be effectively suppressed; that ) (48/32[S]+48/14 [N])% by weight of Ti is consumed in the formation of TiS and TiN, and only the remaining Ti serves to fix [C]; and that, when the remaining Ti is called as [effective Ti] and a Ti-containing low carbon cold rolled steel sheet containing [effective Ti] in an amount smaller than (4 times amount of [C] content plus 0.05% by weight) but larger than (4 times amount of [C] content minus 0.015% by weight) is heat treated within a continuous annealing temperature range selected depending upon the value of {[effective Ti]% by weight −4[C]% by weight}, and the heat treated sheet is rapidly cooled, the resulting steel sheet has non-ageing property at room temperature, high baking hardenability and excellent drawability having an $\bar{r}$ value of at least 1.8. The inventors have made various investigations based on this discovery, and accomplished the present invention.

That is, the feature of the present invention lies in a method of producing a thin steel sheet having baking hardenability and adapted for drawing, including subjecting a cold rolled thin steel sheet, which has a composition containing 0.001–0.010% by weight of C, not more than 1.0% by weight of Mn, not more than 1.2% by weight of Si, not more than 0.1% by weight of P, not more than 0.02% by weight of S and not more than 0.01% by weight of N, and further containing [effective Ti] in an amount larger than (4 times amount of [C] content minus 0.015% by weight) but smaller than (4 times amount of [C] content plus 0.05% by weight), the [effective Ti] being remaining Ti after (48/32[S]+48/14[N]) % by weight of Ti is subtracted from the total amount of Ti depending upon the [S] and [N] contents in the steel, to a continuous annealing under a condition that the sheet is heated at a temperature, which lies within the range of from 850° to 950° C. and further lies within the range of from 850° C.+(70/0.05){[effective Ti]% by weight —4[C]% by weight}° C. to 950° C.+(100/0.015){[effective Ti]% by weight —4[C]% by weight}° C. depending upon the amount of [effective Ti] and [C] content, for a period of time of from 10 seconds to 5 minutes, and the above heated sheet is rapidly cooled at a cooling rate of at least 10° C. per second within the temperature range of 850°-500° C. during the cooling step following to the heating.

When a carbide-forming element is added to extra-low carbon steel to decrease solid solved carbon in the steel, and further a strengthening element, such as P, is added to the steel, the steel stiffens in the secondary working as explained above. Such drawback can be obviated by the present invention. The mechanism for preventing the stiffening of the steel is not clear. However, the inventors have considered that the amount of solid solved C contained in the steel at the recrystallization is not so large enough to check the development of aggregation texture {111}, but after the recrystallization, TiC is dissolved in the steel to increase the amount of solid solved C and to give a baking hardenability to the steel, and at the same time C segregated at the grain boundary disturbs the grain boundary segregation of P to prevent the stiffening of the grain boundary.

An explanation will be made hereinafter with respect to the reason for limiting the components constituting the steel of the present invention and to the reason for limiting the annealing condition.

C is an element necessary for giving baking hardenability to steel. However, the use of a larger amount of C deteriorates the $\bar{r}$ value of steel. Therefore, the lower limit of the amount of C is limited to 0.001% by weight, and the upper limit thereof is limited to 0.01% by weight.

Si and Mn are added to steel in order to give a sufficiently high strength to the steel in order that the steel is used as a high tensile strength cold rolled steel sheet. However, the addition of a larger amount of Si and Mn to steel lowers the elongation and $\bar{r}$ value of the steel and further deteriorates its chemical treatment property and the like. Therefore, the upper limit of Si is limited to 1.2% by weight, and that of Mn is limited to 1.0% by weight.

P improves the strength of steel similarly to Mn and Si. Moreover, P is an element having the lowest influence upon the lowering of the $\bar{r}$ value of steel within the range of C and Ti contents defined in the present invention. However, the addition of more than 0.1% by weight of P to steel lowers the elongation of the steel, and further deteriorates its spot weldability. Therefore, the upper limit of P is limited to 0.1% by weight.

S and N are harmful elements which stiffen steel sheet. However, the influence of S and N can be eliminated by the use of Ti. However, when the content of S and/or N in steel is excessively high, Ti must be used in a large amount, and the resulting steel sheet is expensive. Moreover, a large amount of TiN and TiS is precipitated in the steel to lower its elongation. Therefore, it is necessary that N is contained in the steel of the present invention in an amount of not more than 0.01% by weight, and S is contained in the steel in an amount of not more than 0.02% by weight.

Ti is the most important addition element in the present invention. That is, when Ti is used in an amount defined in the present invention and a recrystallization annealing is carried out under a condition defined in the present invention, a steel sheet having high $\bar{r}$ value and ductility and further having non-ageing property at room temperature and baking hardenability can be produced.

In the present invention, it is firstly necessary in order to prevent the adverse influence of S and N upon the property of steel that the amount of [effective Ti] is larger than 0.

Further, the lower limit of the amount of [effective Ti] 1 is defined by the formula, [effective Ti](% by weight)>{4[C](% by weight) —0.015}, due to the reason that, when the amount of [effective Ti] is not larger than {4,[C](% by weight) —0.015}% by weight, the steel age-deteriorates at room temperature. While, when a steel contains [effective Ti] in an amount defined by the formula, [effective Ti](% by weight)>{4[C](% by weight)+0.05}, a sufficiently high baking hardenability cannot be obtained by an annealing temperature within the range capable of obtaining a high $\bar{r}$ value. Therefore, the uppr limit of the amount of effective Ti is defined by the formula, [effective Ti]<{4[C](% by weight)+0.05}.

When a cold rolled thin steel sheet having the above described composition is heated and continuously annealed, if the sheet is heated at a temperature higher than 950° C., the annealed sheet is very low in the $\bar{r}$ value, while if the sheet is heated at a temperature lower than 850° C., the annealed sheet is insufficient in the baking hardenability. Therefore, the annealing temperature must be within the range of from 850° to 950° C.

Furthermore, the annealing temperature range for obtaining a steel sheet having non-ageing property at room temperature and having baking hardenability varies depending upon the Ti content. That is, in the case of {[effective Ti](% by weight) −4[C](% by weight)}<0, when the steel is heated to a temperature higher than 950° C.+(100/0.015){[effective Ti](% by weight) −4[C](% by weight)}, the annealed sheet age-deteriorates at room temperature. While, in the case of [effective Ti](% by weight) −4[C](% by weight)>0, when the steel is heated at a temperature lower than 850° C.+(70/0.05){[effective Ti](% by weight) −4[C](% by weight)}, the annealed sheet is insufficient in the baking hardenability. Based on the above described reason, the annealing temperature is limited to a temperature, which is within the range of from 850° to 950° C. and within the range of from 850° C.+(70/0.05){[effective Ti](% by weight) −4[C](% by weight)}to 950° C.+(100/0.015){[effective Ti](% by weight) −4[C](% by weight)}.

When a cold rolled steel sheet is heated within the above described temperature range, it is not necessary to keep the sheet within this temperature range. However, when the steel sheet is maintained for a period of time of at least 10 seconds, the texture of the steel sheet becomes uniform. While, when the steel sheet is maintained for a period of more than 5 minutes, the production efficiency of the aimed steel sheet is low and the cold-work embrittleness of the steel sheet concurrently becomes high. Therefore, the heating time of the steel sheet is limited to from 10 seconds to 5 minutes.

When the above heated sheet is cooled at a cooling rate of less than 10° C. per second, the baking hardenability is lost, and there is a risk of stiffening in the secondary working. Therefore, a cooling rate of at least 10° C. per second is necessary, and a cooling rate of at least 25° C. per second is preferable. Even when a high speed cooling is carried out at a rate of not less than 100° C. per second, the baking hardenability is no longer improved. However, a high speed cooling, such as mist cooling or water cooling, may be carried out. In the cooling, it is neither necessary to start the rapid cooling just after the annealing, nor necessary to cool rapidly the sheet to room temperature. When the sheet is rapidly cooled at the above described cooling rate within the temperature range of 850°-500° C., the baking hardenability can be secured.

BRIEF DESCRIPTIION OF THE DRAWINGS

BEST MODE OF CARRYING OUT THE INVENTION

A steel having a composition shown in the following Table 1 was melted under vacuum, and the molten steel was made into a cold rolled steel sheet having a thickness of 0.6 mm through hot rolling and cold rolling. The cold rolled steel sheet was annealed for 2 minutes at various temperatures within the range of 830°-980° C., cooled at a rate of 30° C./sec, and then subjected to a skin pass rolling at a reduction rate of 0.6%. The resulting thin steel sheet was examined with respect to its ageing property, baking hardenability and $\bar{r}$ value.

TABLE 1

| No. | C | Si | Mn | P | S | Ti | N | Effective Ti | Mark "o" indicates steel of this invention |
|---|---|---|---|---|---|---|---|---|---|
| 1 | 0.003 | 0.01 | 0.20 | 0.011 | 0.005 | 0.036 | 0.0027 | 0.019 | o |
| 2 | 0.003 | 0.01 | 0.21 | 0.017 | 0.005 | 0.058 | 0.0031 | 0.040 | o |
| 3 | 0.004 | 0.01 | 0.27 | 0.012 | 0.004 | 0.029 | 0.0025 | 0.014 | o |
| 4 | 0.005 | 0.01 | 0.25 | 0.007 | 0.005 | 0.061 | 0.0027 | 0.044 | o |
| 5 | 0.005 | 0.01 | 0.23 | 0.008 | 0.006 | 0.087 | 0.0031 | 0.067 | o |
| 6 | 0.008 | 0.01 | 0.18 | 0.011 | 0.005 | 0.040 | 0.0027 | 0.023 | o |
| 7 | 0.008 | 0.02 | 0.30 | 0.010 | 0.004 | 0.061 | 0.0033 | 0.044 | o |
| 8 | 0.008 | 0.01 | 0.31 | 0.007 | 0.006 | 0.086 | 0.0035 | 0.065 | o |
| 9 | 0.009 | 0.02 | 0.27 | 0.011 | 0.005 | 0.107 | 0.0034 | 0.088 | |

TABLE 1-continued

| No. | C | Si | Mn | P | S | Ti | N | Effective Ti | Mark "o" indicates steel of this invention |
|---|---|---|---|---|---|---|---|---|---|
| 10 | 0.010 | 0.01 | 0.21 | 0.009 | 0.008 | 0.044 | 0.0028 | 0.022 | |
| 11 | 0.010 | 0.01 | 0.20 | 0.010 | 0.006 | 0.072 | 0.0024 | 0.055 | o |
| 12 | 0.011 | 0.02 | 0.20 | 0.012 | 0.007 | 0.107 | 0.0028 | 0.087 | |

Figure 1:
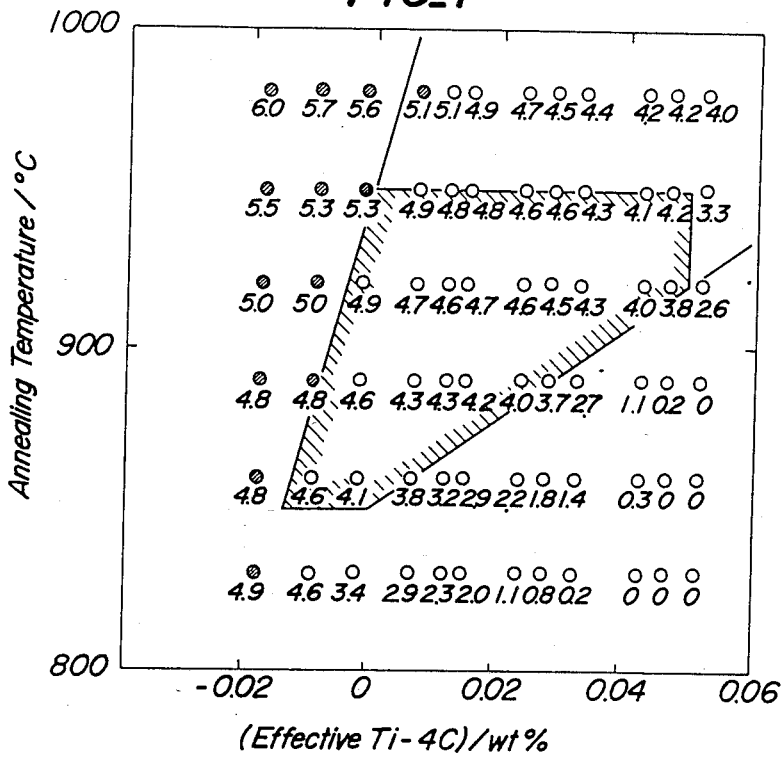
FIG. 1 is a graph illustrating a relation between the Ti content and the annealing temperature, illustrating a proper annealing temperature range surrounded by hatched lines.

FIG. 1 shows the range of the amount of [effective Ti] and the range of the heating temperature which can produce non-ageing thin steel sheets having a baking hardenability of at least 4 kg/mm$^2$.

In FIG. 1, the black circle represents thin steel sheets which exhibited the yield elongation in the tensile test after the steel sheets were maintained at 30° C. for 30 days; while the white circle represents thin steel sheets which were free from the yield elongation in the tensile test.

Further, the numerals in FIG. 1 represent the difference between the yield stress of a thin steel sheet after the following heat treatment and the deforming stress thereof before the heat treatment. That is, a prestrain of 2% is given to a thin steel sheet by a tensile deformation, the prestrained sheet is subjected to a heat treatment at 170° C. for 20 minutes, and a tensile test of the heat treated steel sheet is again carried out. In the following experiments, the ageing property at room temperature and the baking hardenability of steel sheet were examined in the same manner as described above.

As the results, the following facts were found out. When a steel containing Ti in an amount defined by the following formula, {[effective Ti](% by weight) −4[C](% by weight)}<0, is annealed at a temperature higher than 950° C.+(100/0.015){[effective Ti](% by weight)−4[C](% by weight)}, yield elongation appears in the annealed steel and the steel is no longer non-ageing at room temperature. While, when a steel containing Ti in an amount defined by the following formula, {[effective Ti](% by weight)−4[C](% by weight)}>0, is annealed at a temperature lower than 850° C.+(70/0.05){[effective Ti](% by weight)−4[C](% by weight)}. the increasing of the deforming stress of the steel by the heat treatment is 4 kg/mm$^2$or less, and the annealed steel is insufficient in the baking hardenability.

Further, it has been found that a steel containing Ti in an amount defined by the following formula, {[effective Ti](% by weight)−4[C](% by weight)}<−0.015, cannot be made into a non-ageing steel at room temperature even when the steel is annealed at any temperature. Reversely, a steel containing Ti in an amount defined by the following formula, {[effective Ti](% by weight)−4[C](% by weight)}>0.05, must be annealed at a temperature not lower than 950° C. in order to obtain a baking hardenability of at least 4 kg/mm$^2$.

Figure 2:
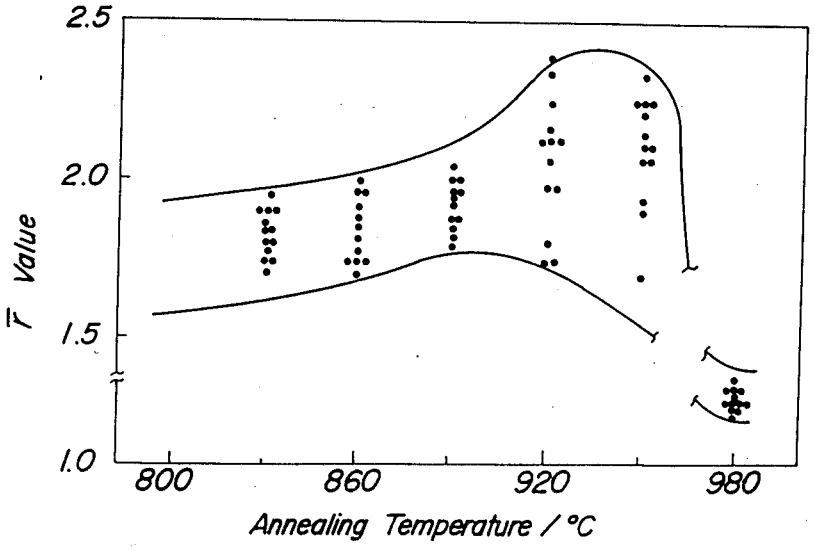
FIG. 2 is a graph illustrating the variation of $\bar{r}$ value due to the variation of annealing temperature.

FIG. 2 illustrates the variation of $\bar{r}$ value due to the variation of annealing temperature of these steel sheets. Although there is a scattering between steels in the $\bar{r}$ substantially all the annealed steels, except a part of the steels, have an $\bar{r}$ value higher than 1.8 at the annealing temperature of 830°-950° C. However, when the annealing temperature is 980° C., the $\bar{r}$ value of the annealed sheets is very low and is about 1.2-1.3. Therefore, the annealing temperature must be not higher than 950° C. in order to obtain a high $\bar{r}$ value.

Figure 3:
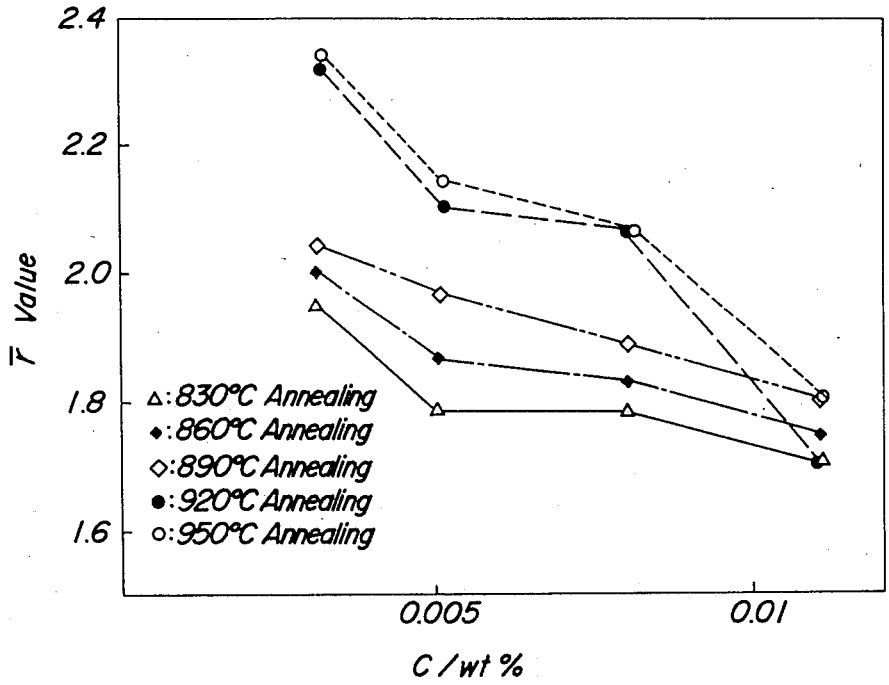
FIG. 3 is a graph illustrating the variation of $\bar{r}$ value due to the variation of the C content in a steel.

FIG. 3 illustrates the change of $\bar{r}$ value due to the change of [C] content at various annealing temperatures, which has been measured by using steel Nos. 2, 5, 8 and 12 among the above described steels. In any annealing temperatures, as the [C] content in steel is higher, the $\bar{r}$ value thereof decreases. As the results, it has been found that the [C] content in steel must be lower than 0.01% by weight in order to obtain stably steels having an $\bar{r}$ value of higher than 1.8.

A steel having a composition shown in the following Table 2 was melted by vacuum melting, the molten steel was made into a cold rolled steel sheet having a thickness of 0.6 mm through hot rolling and cold rolling, and the cold rolled steel sheet was annealed at 890° C. for 2 minutes and then cooled at a rate of 30° C./sec. The above cooled steel sheet was subjected to a skin pass rolling at a reduction rate of 0.6%, and then subjected to a tensile test. The skin pass rolled sheet was further measured with respect to its $\bar{r}$ value and baking hardenability. The sheet was further molded into a cylindrical cup, and the cup was subjected to a drop hammer test to examine the stiffening property in the secondary working. The obtained results are shown in the following Table 3.

TABLE 2

| No. | C | Si | Mn | P | S | Ti | N | Effective Ti | Mark "o" indicates steel of this invention | |
|---|---|---|---|---|---|---|---|---|---|---|
| 13 | 0.005 | 0.01 | 0.32 | 0.015 | 0.005 | 0.048 | 0.0031 | 0.030 | o | |
| 14 | 0.004 | 0.01 | 0.31 | 0.057 | 0.005 | 0.041 | 0.0027 | 0.024 | o | P |
| 15 | 0.004 | 0.02 | 0.28 | 0.090 | 0.006 | 0.055 | 0.0022 | 0.038 | o | |
| 16 | 0.005 | 0.01 | 0.30 | 0.118 | 0.005 | 0.063 | 0.0033 | 0.044 | | |
| 17 | 0.005 | 0.01 | 0.61 | 0.061 | 0.004 | 0.050 | 0.0025 | 0.035 | o | Mn |
| 18 | 0.006 | 0.01 | 0.93 | 0.063 | 0.004 | 0.063 | 0.0031 | 0.046 | o | |
| 19 | 0.005 | 0.02 | 1.17 | 0.055 | 0.004 | 0.054 | 0.0028 | 0.038 | | |
| 20 | 0.006 | 0.30 | 0.31 | 0.058 | 0.005 | 0.053 | 0.0030 | 0.038 | o | |
| 21 | 0.004 | 0.80 | 0.33 | 0.060 | 0.004 | 0.056 | 0.0027 | 0.038 | o | Si |
| 22 | 0.005 | 1.5 | 0.29 | 0.062 | 0.004 | 0.058 | 0.0031 | 0.041 | | |
| | | | | | | | | | (wt. %) | |

TABLE 3

| No. | YS (kg/mm²) | TS (kg/mm²) | El (%) | $\bar{r}$ value | Evaluation* for stiffening property in the secondary working | Baking hardenability |
|---|---|---|---|---|---|---|
| 13 | 19.3 | 32.1 | 46 | 2.13 | 3 | 4.4 |
| 14 | 22.2 | 35.2 | 41 | 2.04 | 3 | 4.6 |
| 15 | 24.8 | 37.8 | 39 | 2.11 | 3 | 4.6 |
| 16 | 25.2 | 38.9 | 34 | 1.94 | 4 | 4.4 |
| 17 | 23.7 | 37.6 | 38 | 1.82 | 3 | 4.2 |
| 18 | 25.5 | 39.7 | 36 | 1.77 | 3 | 4.5 |
| 19 | 27.1 | 41.2 | 35 | 1.44 | 3 | 4.9 |
| 20 | 24.1 | 38.2 | 36 | 1.88 | 2 | 4.2 |
| 21 | 27.8 | 42.2 | 35 | 1.86 | 3 | 4.2 |
| 22 | 29.3 | 45.1 | 33 | 1.51 | 3 | 4.0 |

*3 or less: good
4: fairly good
5: poor

No. 16 steel sheet containing about 0.12% by weight of P has a tendency that the steel sheet stiffens in the secondary working.

Each of cold rolled steel sheets of Nos. 13, 14 and 15 described in Table 2 was subjected to an annealing at 890° C. for 2 minutes, cooled under a condition that cooling to 500° C. was carried out at a cooling rate of 2° C./sec, 5° C./sec, 10° C./sec, 30° C./sec, 50° C./sec or 100° C./sec, prestrained under a tension of 2%, and then subjected to the Charpy impact test at a test temperature of -100° C. to measure the energy absorbed in the steel sheet. The obtained results are shown in FIG. 4.

Figure 4:
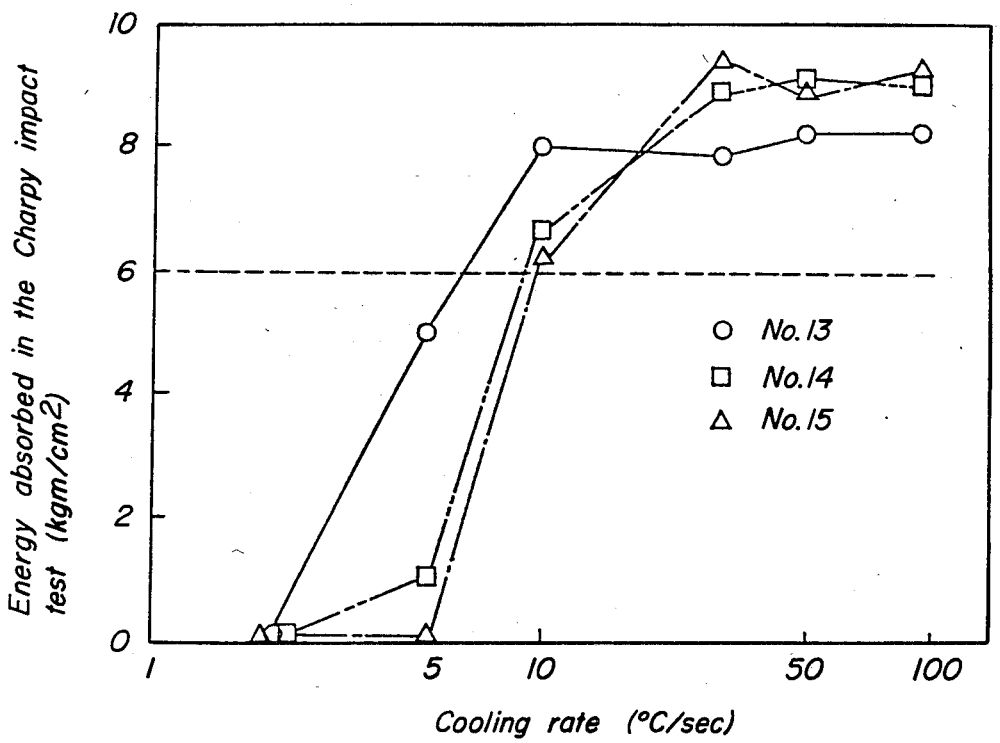
FIG. 4 is a graph illustrating the relationship between the cooling rate and the absorbed striking energy.

It can be seen from FIG. 4 that, when the cooling rate is higher, the absorbed striking energy is larger, and the steel sheet is less stiff. A cold rolled sheet containing a larger amount of P requires a higher cooling rate in order to obtain a steel sheet having a low stiffness, but a cooling rate of at least 10° C./sec gives a striking energy-abosrbing property of at least 6 kg.m/cm² to all steel sheets.

While, it is known that steel sheet containing more than 0.10% by weight of P is poor in the spot weldability. Therefore, it is necessary that the steel of the present invention has a P content of 0.04–0.1% by weight. When a solid solution strengthening effect due to P is insufficient and a steel having a necessary strength cannot be obtained, the addition of Si or Mn to the steel is effective. However, No. 19 or No. 22 steel sheet containing 1.17% by weight of Mn or 1.5% by weight of Si, respectively, has an $\bar{r}$ value of not higher than 1.8. That is, an Si content of higher than 1.2% by weight or Mn content of higher than 1.0% by weight in a steel cannot give a high $\bar{r}$ value to the steel.

The following example is given for the purpose of illustration of this invention.

A steel slab having a composition shown in the following Table 4 was hot rolled at a finishing temperature of 880° C. to produce a hot rolled sheet having a thickness of 2.6 mm, and the hot rolled sheet was coiled at a temperature of 580° C., pickled to remove scale and then cold rolled to produce a cold rolled sheet having a thickness of 0.7 mm. The cold rolled sheet was annealed under a condition that the sheet was heated at 90° C. for 2 minutes and then cooled at a cooling rate of 20° C./sec, and the annealed sheet was subjected to a skin pass rolling at a reduction rate of 0.6% to produce a thin steel sheet. The properties of the resulting thin steel sheets were examined. The obtained results are shown in the following Table 5.

Steel sheets A, C, D, E and F produced according to the present invention have a high $\bar{r}$ value of at least 1.8 and a high baking hardenability of at least 4 kg/mm², and are non-ageing at room temperature.

Therefore, the resulting thin steel sheet for drawing, which has excellent press moldability and further has high dent resistance after bake coating. Cold rolled steel sheet having such baking hardenability and adapted for drawing can be used in various automotive parts, and particularly can decrease the thickness of steel sheet for automobile. Therefore, the steel sheet of the present invention is very contributable for the production of light weight car body, and is very valuable in industry.

TABLE 4

| Sample steel | C | Si | Mn | P | S | Ti | N | Effective Ti | Mark "o" indicates steel of this invention |
|---|---|---|---|---|---|---|---|---|---|
| A | 0.004 | 0.02 | 0.27 | 0.01 | 0.01 | 0.050 | 0.0035 | 0.023 | o |
| B | 0.007 | 0.01 | 0.31 | 0.07 | 0.01 | 0.030 | 0.0032 | 0.004 | |
| C | 0.005 | 0.02 | 0.30 | 0.06 | 0.01 | 0.058 | 0.0033 | 0.031 | o |
| D | 0.006 | 0.02 | 0.30 | 0.07 | 0.01 | 0.12 | 0.0021 | 0.098 | |
| E | 0.007 | 0.02 | 0.61 | 0.07 | 0.01 | 0.073 | 0.0030 | 0.048 | o |
| F | 0.006 | 0.60 | 0.31 | 0.06 | 0.01 | 0.079 | 0.0033 | 0.053 | o |

TABLE 5

| | YS (kg/mm²) | TS (kg/mm²) | El (%) | $\bar{r}$ value | Baking hardenability (kg/mm²) | Ageing* property (%) |
|---|---|---|---|---|---|---|
| A | 16.3 | 31.0 | 48 | 2.00 | 4.5 | 0 |
| B | 24.0 | 36.3 | 41 | 1.92 | 5.6 | 1.1 |
| C | 23.2 | 36.0 | 42 | 2.03 | 4.4 | 0 |
| D | 22.9 | 36.8 | 42 | 1.89 | 0 | 0 |
| E | 24.3 | 39.2 | 37 | 1.81 | 4.3 | 0 |
| F | 25.2 | 41.0 | 37 | 1.83 | 4.2 | 0 |

*Yield elongation after left to stand for one month at 30° C.

We claim:

1. A method of producing a thin steel sheet adapted for drawing, comprising subjecting a cold rolled thin steel, which has a composition containing 0.001–0.010% by weight of C, not more than 1.0% by weight of Mn, not more than 1.2% by weight of Si, not more than 0.1% by weight of P, not more than 0.02% by weight of S and not more than 0.01% by weight of N, and further containing effective Ti in an amount larger than (4 times amount of [C] content minus 0.015% by weight ) but smaller than (4 times amount of [C] content plus 0.05% by weight) said effective Ti being remaining Ti after (48/32[S]+48/14[N])% by weight of Ti is substracted from the total amount of Ti depending upon the [S] and [N] contents in the steel, to a continuous annealing under a condition that the sheet is heated at a temperature, which lies within the range of from 850° to 950° C. and further lies within the range of from 850° C.+(70/0.05){[effective Ti]% by weight−4% by weight ° C. to 950° C.+(100/0.015){[effective Ti] % by weight −4[C]% by weight}° C. depending upon the amount of [effective Ti] and [C] content, for a period of from 10 seconds to 5 minutes, and the above heated sheet is rapidly cooled at a cooling rate of at least 10° C. per second within the temperature range of 850°-500° C. during the cooling step following to the heating, so as to obtain the thin steel sheet having a striking energy-absorbing property of at least 6 kgm/cm$^2$ in a Charpy impact test at −100° C., a r value of at least 1.8 and a baking hardenability of at least 4 kg/mm$^2$.

* * * * *